US008359753B1

(12) United States Patent
Frazer

(10) Patent No.: US 8,359,753 B1
(45) Date of Patent: Jan. 29, 2013

(54) ACTUATING OPENING SYSTEM FOR FOLDING KNIFE

(75) Inventor: Spencer Frazer, Lynnwood, WA (US)

(73) Assignee: SOG Specialty Knives and Tools, Lynnwood, WA (US)

( * ) Notice: Subject to any disclaimer, the term of this patent is extended or adjusted under 35 U.S.C. 154(b) by 859 days.

(21) Appl. No.: 12/022,897

(22) Filed: Jan. 30, 2008

(51) Int. Cl.
*B26B 3/06* (2006.01)
*F41C 27/18* (2006.01)
*F41B 13/02* (2006.01)

(52) U.S. Cl. ..... 30/158; 30/155

(58) Field of Classification Search ..... 30/155, 30/158, 159, 160, 161, 307, 319, 164, 95, 30/365, 114, 2, 151, 162, 286, 289, 292, 30/293
See application file for complete search history.

(56) References Cited

U.S. PATENT DOCUMENTS

| | | | | |
|---|---|---|---|---|
| 1,931,360 | A | 10/1933 | Schrade | |
| 2,199,430 | A * | 5/1940 | Greve | 30/160 |
| 3,942,249 | A | 3/1976 | Poehlmann | |
| 4,095,337 | A | 6/1978 | Pharr | |
| 4,177,560 | A | 12/1979 | Sakurai | |
| 4,347,665 | A | 9/1982 | Glesser | |
| 4,404,748 | A | 9/1983 | Wiethoff | |
| 4,551,917 | A | 11/1985 | Walker | |
| D302,649 | S | 8/1989 | Porsche et al. | |
| 4,918,820 | A | 4/1990 | Korb et al. | |
| 5,009,008 | A | 4/1991 | Yablonovitch | |
| 5,331,741 | A | 7/1994 | Taylor, Jr. | |
| D361,254 | S | 8/1995 | Silberstein | |
| 5,495,674 | A * | 3/1996 | Taylor, Jr. | 30/160 |
| 5,502,895 | A | 4/1996 | Lemaire | |
| D378,489 | S | 3/1997 | Poehlmann | |
| 5,896,665 | A | 4/1999 | Harris | |
| 5,964,035 | A | 10/1999 | Poehlmann | |
| 6,260,461 | B1 * | 7/2001 | Mok | 83/564 |
| 6,550,142 | B1 * | 4/2003 | Moser | 30/153 |
| 6,618,946 | B2 | 9/2003 | Seraphin | |
| D508,194 | S | 8/2005 | Carter | |
| D513,957 | S | 1/2006 | Thirouin | |
| 7,533,465 | B1 * | 5/2009 | Frazer | 30/155 |
| 2005/0223563 | A1 | 10/2005 | VanHoy et al. | |

FOREIGN PATENT DOCUMENTS

| | | |
|---|---|---|
| EP | 100377 | 2/1984 |

OTHER PUBLICATIONS

Wikipedia, "Sprag," found at http://en.wikipedia.org/wiki/Sprag.

* cited by examiner

*Primary Examiner* — Ghassem Alie
*Assistant Examiner* — Bharat C Patel
(74) *Attorney, Agent, or Firm* — Forrest Law Office, P.C.

(57) ABSTRACT

A folding knife is described herein with an actuating system configured to interface with the blade to open the blade. Wherein the actuating system has a moving member to rotate the blade a different amount of rotation with respect to the movement of an interface portion of the actuating portion.

14 Claims, 11 Drawing Sheets

ACTUATING OPENING SYSTEM FOR FOLDING KNIFE

BACKGROUND OF THE INVENTION

Knives, in particular folding knives, are a useful tool for incising various materials. Of course, a very common item to be possessed by an individual of any walk of life is some form of a pocket knife. Pocket knives in general are normally folding pocket knives where the blade is retained within the handle. Of course, various locking mechanisms are utilized to lock the blade open. However, oftentimes it is convenient to have a knife which will open in a somewhat accessible manner, such as with a single hand in an environment where the individual is holding the item to be cut. Continuing with this example, a person may be holding a rope or some other item with one hand, and have to withdraw the knife and open it with the other hand. It is often desirable to have the knife remain in a substantially retained closed position unless there is some sort of actuating type of applied force to deliberately open the knife. As described herein, there is a more detailed apparatus for a type of apparatus broadly claimed to open a knife.

SUMMARY OF THE DISCLOSURE

Disclosed herein is folding knife having a handle region with a forward portion and a rearward portion. The blade had an end region and a base region, is pivotally attached to the handle at the forward region.

An actuating system is provided to open the blade and has an interface portion where repositioning the interface portion actuates the blade from a retracted orientation to an extended orientation. The blade is withdrawn from the handle to the extended orientation where the blade can rotate an angular quantity greater than the angular quantity of rotation of the interface portion of the actuating system. In other words in one form the blade is gearingly attached to an actuating member. Alternatively, for example, the blade is attached by way of a sprocket like member where the blade rotates with the interface portion for the initial portion of rotation and then continues to open while the interface portion no longer moves therewith.

The interfacing portion can be pivotally attached to the forward region of the handle and the engaging portion gearingly attached to the blade. In this form a gear can be fixedly attached to the knife where the gear ratio between the gear on the knife and a gear system attached to the engagement region is less a 2:3 ratio.

In another form interface portion is positioned on a first transverse region of the handle or is positioned on a forward lateral location of the knife. In this form the actuating system has an extension biases a gear portion of a first gear which is gearingly attached to a knife gear that is attached to the blade. Therefore rotation of the extension rotates the first gear to then rotate the knife gear to open the blade. IN this form the first gear can rotate a greater amount than the blade as the blade repositions from a retained orientation to an extended orientation, the actuating system assists in the opening of the blade from a retained orientation to the extracted orientation. The actuating system can have a variety of forms, for example the actuating system can have an engagement surface extending beyond the forward perimeter region of the handle.

The folding knife can be arranged so the actuating system is comprised of a plurality of sprag members attached to a rotating member having an outer region which operates as the interface portion. The sprag members have an inner engagement surface configured to engage the blade in some form to rotate the blade in a positive opening. The sprag members allow for free rotation of the blade in the positive direction when the rotating member is stationary or rotating at a lower angular velocity in the positive opening direction with respect to the blade.

Further disclosed herein is a folding knife having of course a handle having a rearward portion and a forward portion. The blade has an end region and a base region where the base region pivotally attached to the forward region of the handle at blade axis of rotation. Of course the blade is operatively configured to be arranged in a closed orientation and in an open orientation.

Now there is an actuating system having an interface member which is on the handle at an axis of rotation that is not concentric with the blade axis of rotation. The actuating system is configured in a manner so rotating the interference portion with respect to the handle repositions the blade.

In another form disclosed herein is a folding knife with the blade being pivotally attached to the handle at a forward region.

In this form the actuating system comprising an interface portion where repositioning the interface portion actuates the blade from a retracted orientation to an extended orientation. The rotation of the to the extended orientation where the blade is at an angular quantity less than the angular amount of rotation of the interface portion of the actuating system.

Other embodiments and combinations of elements could of course be accomplished and the embodiments shown herein are for example versions of the broader scope of the applicant's concept.

DESCRIPTION OF THE PREFERRED EMBODIMENTS

It should be noted that the gear ratio in the various gears need not be perfectly cylindrical. For example, the engagement portion could further have a straight member which gearingly engages the gear attached to the knife. As long as torque is supplied from the engagement member to a portion of the knife to actuate it open, the knife can be opened and in some forms also closed with the engagement region of the actuating member.

As described herein, there is a knife adapted to be operated by a knife operator where the knife is adapted to be opened by way of an actuating system. In general, the general context described herein is related to a folding knife where the blade is adapted to be positioned from a protracted orientation to an extended orientation by way of utilizing an actuating system.

Figure 1:
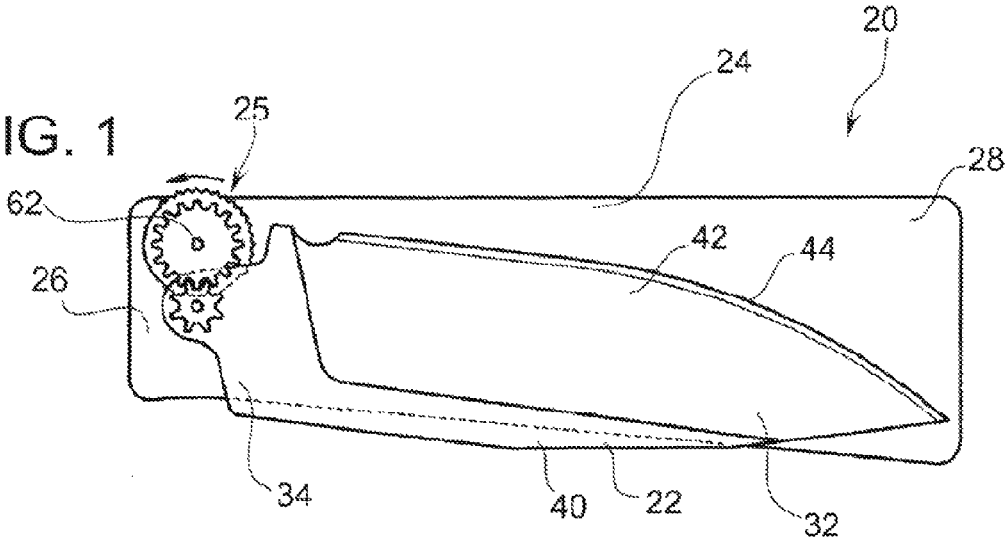
FIG. 1 shows a side schematic profile view of a folding knife where an actually system is provided.
Figure 2:
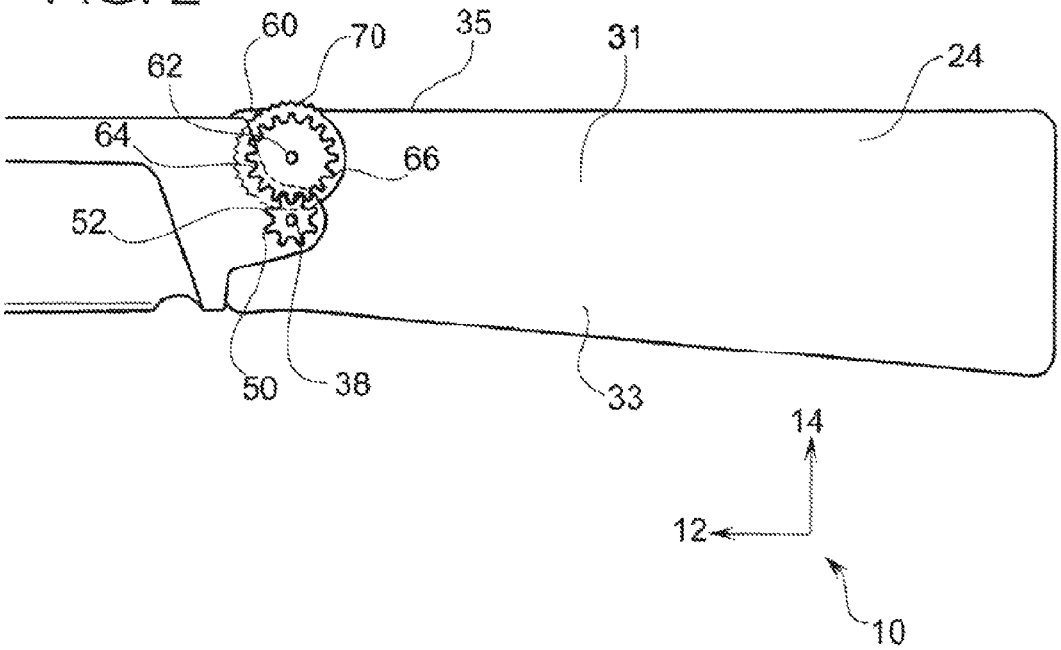
FIG. 2 shows the schematic knife in an open orientation.

To aid in the description of the folding knife 20, as shown in FIG. 2, an axes system 10 is defined where the axis indicated at 12 is a longitudinal axis and pointed in the forward direction. The axis 14 is referred to as a transverse axis which is pointed in a downward direction. And further, an axis orthogonal or substantially orthogonal to the axes 12 and 14 is referred to as the lateral axis. It should be noted that the directions and axes set out general directions and for example the transverse axis is broadly defined as a general downward direction as shown in FIG. 1, not necessarily ninety degrees to the longitudinal axis 12.

Referring now to FIGS. 1 and 2, there is shown the knife 20 generally comprising the blade 22, the handle portion 24, and the blade actuating system 25.

The handle 24 comprises the longitudinally forward region 26 and the longitudinally rearward region 28. The handle further comprises a first transverse region 31 and a second transverse region 33 as shown in FIG. 2. Located in the first transverse region 31 is the upper transverse surface 35 which in part defines a plane which could be a curved plane. As described herein, the plane adjacent to the engagement surface 70 of the first gear member 60 of the actuating system 25 is positioned in a manner to allow free contact of the engagement surface 70. Positioned in the longitudinally forward region 26 is the actuating system 25, which will be described further herein. In general, the actuating system allows for opening of the blade without directly contacting the blade or its outer transverse region 40.

In general, the handle can be of a design where the blade 22 is retained therein in the retained position as shown in FIG. 1.

The blade 22 generally comprises an outer region 32 and a base region 34. The blade is pivotally attached at the forward region 26 of the handle 24 at the pivot attachment location 38. Of course various locking mechanisms can be employed so the blade will remain in a locked orientation, as shown in FIG. 2.

The blade further comprises an outer transverse region 40 and an opposing inner transverse region 42. In the inner transverse region 42, in one form, is the sharpened region having an edge 44. In general, the blade can be of any type of design; however, the blade is adapted to interact with the actuating system 25 so as to withdraw it from a retained orientation to an extracted orientation (see FIGS. 1 and 2).

The blade, in one form, has a knife gear 50 fixedly attached thereto which is adapted to rotate therewith. The knife gear 50 has a plurality of cogs 52 which, as described herein, are adapted to interface with the first gear member 64 of the actuating system 25. It should be first stated here that a variety of types of actuators can be employed. Although gears are used, other types of torque transferring mechanisms such as belts or the like could be utilized.

The actuating system 25 as shown in FIGS. 1 and 2 in one form comprises, in part, the first gear member 60 which is pivotally attached at the location 62. The first gear member 60 has a gear portion 64 having a plurality of cogs 66 that are adapted to engage the cogs 52 of the knife gear 50. The first gear member 64 further has an engagement surface 70, which in one form is positioned along the first transverse region 31 of the handle 24. In one form, the engagement surface 70 extends beyond the plane defined by the immediate surface of the handle 24 for engagement of, for example, the operator's thumb to extract the blade.

Now referring to FIGS. 3-9C, there is shown a second embodiment where a second type of actuating system is employed.

Figure 7A:
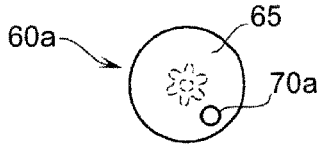
FIGS. 7A-7C show side and front views of a first gear member utilized as part of an actuating system.
Figure 7B:
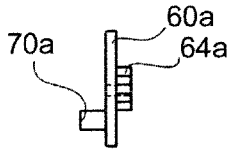
Figure 7C:
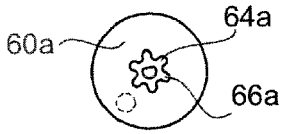
Figure 8:
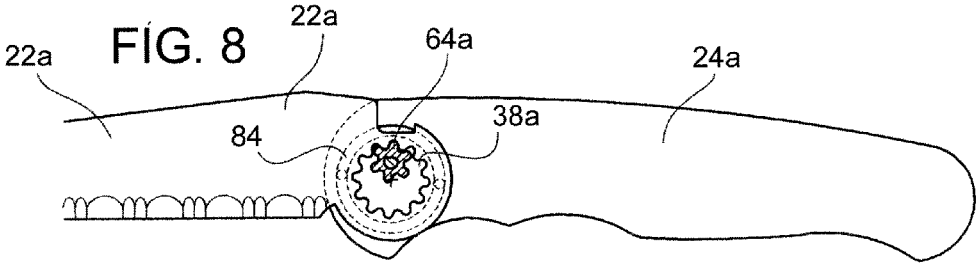
FIG. 8 is a partial sectional view illustrating the general principle of the inner gear portion in engagement with a knife gear.

Referring ahead to FIGS. 7A-7C, there is shown one possible component where the first gear member 60*a*. The engagement surface 70*a* in this form is positioned in a lateral location. As shown in FIG. 7B, the gear portion 64*a* is positioned on an opposed lateral region, where as shown in FIG. 7C, the gear portion 64*a* has a plurality of cogs 66*a* that are adapted to engage the knife gear 38 as shown in FIG. 8. Referring back to FIG. 6, it can be seen that the first gear 60*a* is pivotally attached at the pivot location 62*a* of the handle 24*a*. In one form, the engagement surface 70*a* protrudes laterally outwardly but of course could be in other configurations such as an indentation of the outer surface 65, or any other type of surface or force receiving location to apply a torque to the first gear member 60*a*, or in the case of a linear type motion of (for example) having the cogs 66*a* aligned in a linear manner, and engaged in a linear/non-cylindrical manner, the engagement portion transfers the energy to a rotational torque for the knife blade point 22*a*.

Figure 9A:
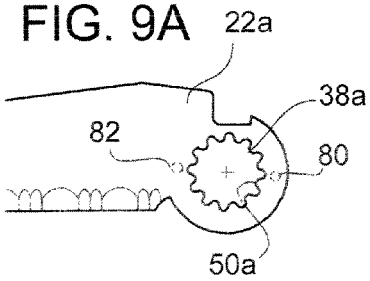
FIG. 9A shows a close-up view of one form of a blade having a knife gear therein.
Figure 9B:
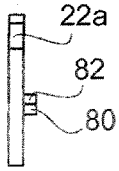
FIG. 9B shows a view along the longitudinal axis of the blade showing extensions which in one form are retaining the blade at least in part to the handle.

Referring now to FIG. 8, the blade 22*a* has a knife gear 38*a* which in this form as shown in FIG. 9*a* is an internal type gear having the cogs 50*a* face radially inwardly. In one form, the extensions 80 and 82 extend in the lateral direction and are adapted to receive the angular groove 84 as shown in FIG. 8. Of course, other types of connecting mechanisms can be employed, such as a bearing assembly or another form of pivotally connecting the blade 22*a* to the handle 24*a*.

Figure 3:
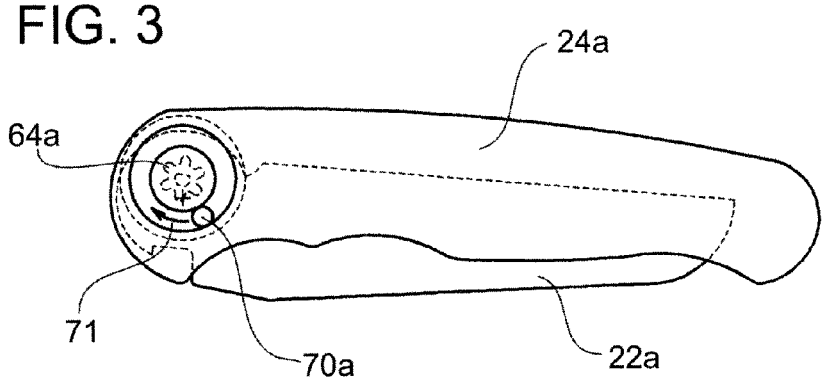
FIG. 3 shows another embodiment of a knife with an actuating system of a different design.
Figure 4:
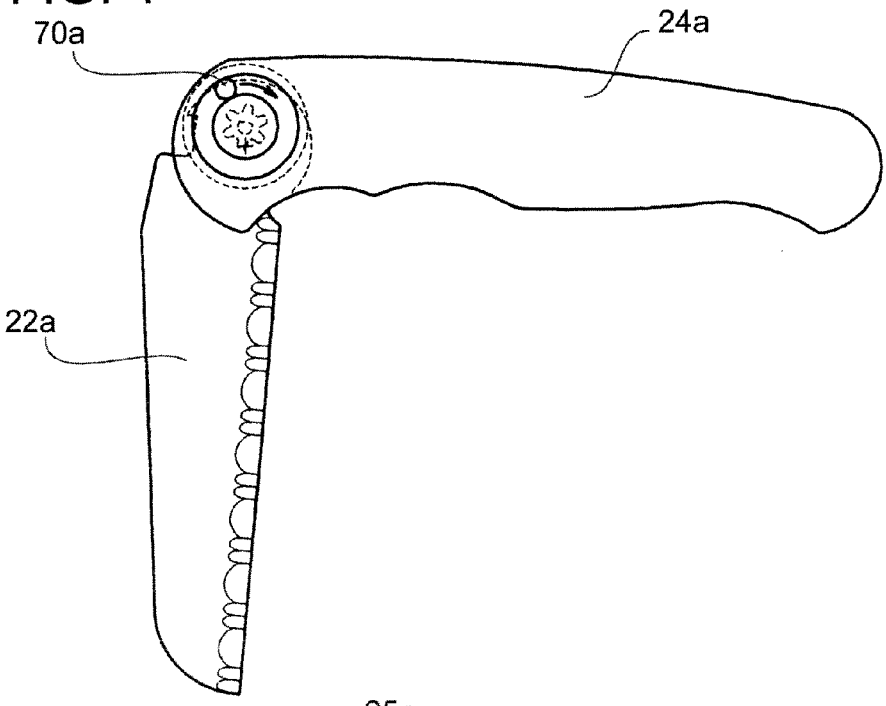
FIG. 4 shows a view of the second embodiment with the blade in a partially open orientation.
Figure 5:
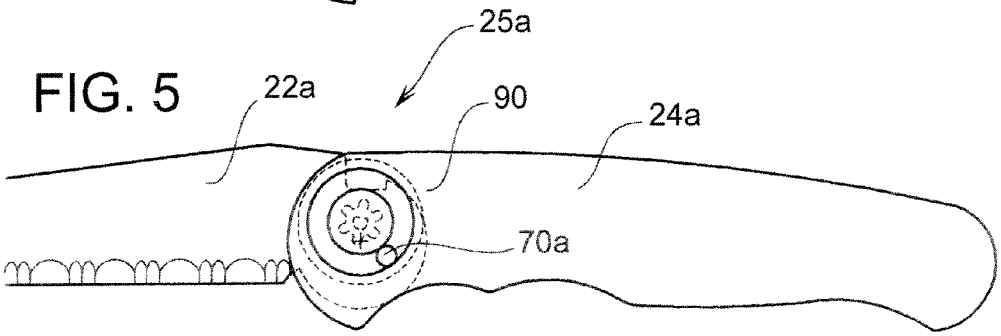
FIG. 5 shows the blade of a second embodiment in the full open orientation.
Figure 6:
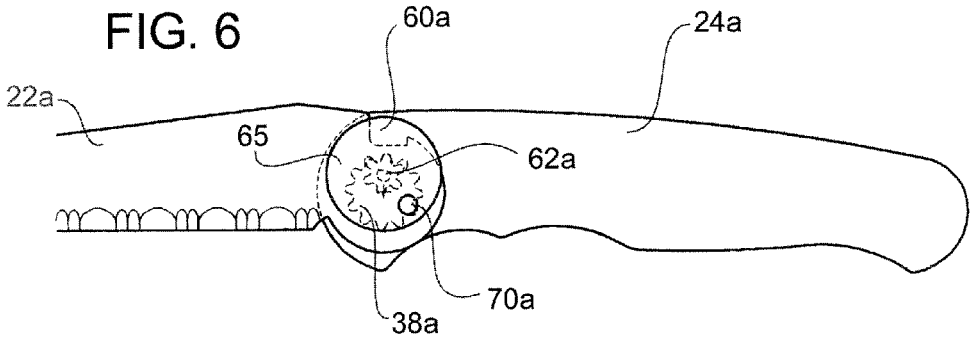
FIG. 6 shows a partial sectional view showing the internal gear mechanism of the second embodiment.

Referring now back to FIGS. 3-5, it can be appreciated that when the operator applies force to the engagement surface 70*a* in the manner as shown by the arrow 71, the first gear 64*a* rotates in this clockwise direction. Referring now to FIG. 8, it can be appreciated how the first gear 64*a* would transfer the torque to the knife gear 38*a* (see FIG. 6). Depending upon the ratio of the cogs 66*a* (see FIG. 7C) to the cogs 50*a* (see FIG. 9*a*), the amount of rotation of the first gear member 60*a*, in this form, will be greater than the amount of rotation of the blade 22*a*. For example, as shown in FIG. 4, it can be appreciated how the lateral extension, which in one form is the engagement surface 70*a*, is rotated approximately 180°, but the blade 22*a* has rotated 90°. Now referring to FIG. 5, it can be appreciated how the blades is in the extended orientation with respect to the handle and the actuating system 25*a* in this form has rotated 360°.

Of course, it can be appreciated that a different number of cogs can be utilized, where for example with a different ratio of cogs of the mutual gears, the rotation could be 270°. Further, it should be noted that if a spring assisted system is utilized where for example a spring-like member is positioned within the handle at the forward region at 90, as soon as the operator begins the rotation as shown in FIG. 3, the spring assisted system can take over to open up the blade 22*a* as described with reference to FIGS. 15-29 further herein. In this form, the potential energy of the spring member would take over the torque rotation and the first gear would rotate without assistance of the operator to the fully opened orientation.

It should be noted that the forward region 90 defines a lateral surface adjacent to the interface portion 70*a* where the lateral surface defines a plane that is laterally inward from the interface portion 70*a* in one form.

Figure 9C:
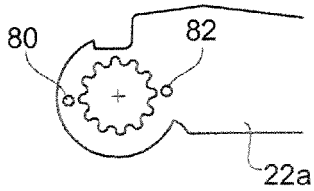
FIG. 9C shows an opposing side view of FIG. 9A.
Figure 10:
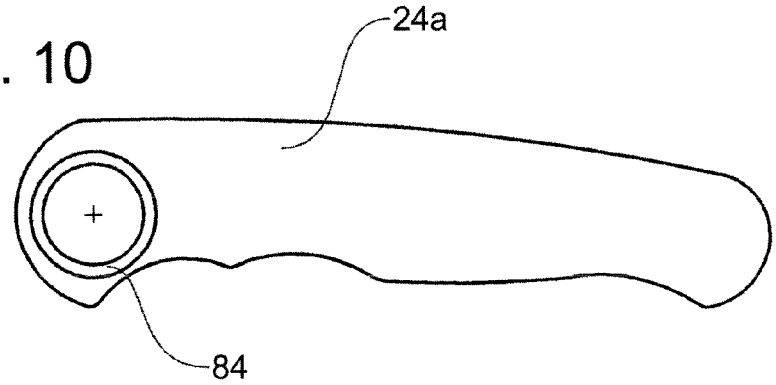
FIG. 10 shows the schematic view of one type of a handle.

FIG. 10 shows one form of a handle member 24*a* where the annular groove 84 is provided to house the blade. Of course, a variety of connection mechanisms can be utilized in other types of extensions other than the extensions 80 and 82, as shown in FIG. 9C. Now referring to FIG. 11, there is shown another embodiment where the engagement surface 70*b* is positioned in a longitudinally forward region as well as a transverse region. In this form for example, the operator can extend the blade 22*b* by grasping the lateral regions of the handle 24*b*, and for example have the forefinger engage the engagement surface 70*b* to place a torque thereon as indicated by the arrow 100.

Figure 11:
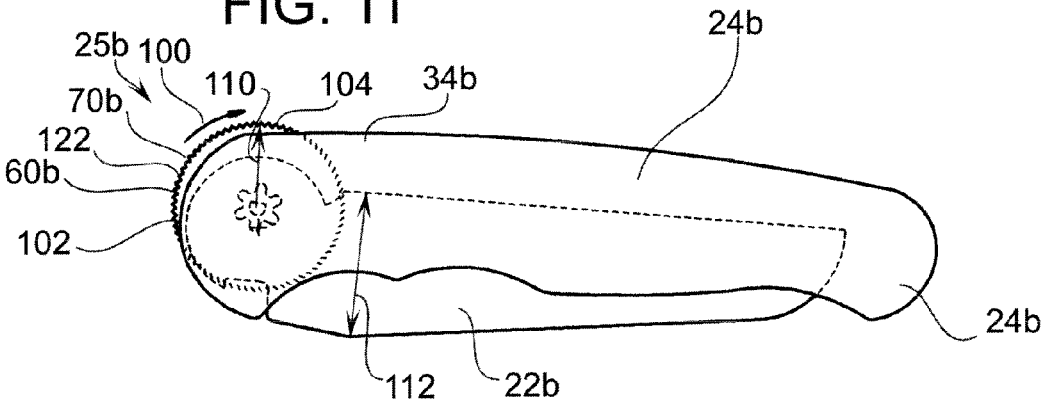
FIG. 11 shows another type of actuating system where the engagement surface to activate the knife is in the longitudinal forward portion of the handle.

In this form, the engagement area can extend to the exposed region all the way down to the area indicated at 102 up to the upper second transverse region indicated at 104. In one form, up to 180° of the circular surface indicated at 70*b* can be exposed. Of course more or less surface 70*b* can be defined by way of various designs of the knife and the surrounding surface indicated at 35*b*. This form allows for a large degree of engagement to apply a frictional force thereto, where in one form the gnarled or groove-like surface 70*b* increases the coefficient of friction therewith the finger portion of the knife operator. Of course, the diameter of the first gear member 60*b*, and more particularly the diameter of the engagement surface 70*b* can be arranged for applying various amounts of levered torque upon the actuating system 25*b*. For example, a smaller diameter may induce less torque, but may be sufficient to open the knife by a knife operator. Further, by employing the spring actuating system, a larger diameter actuating system can be utilized to provide a greater amount of starting torque to get the knife open, where the spring would take over thereafter. In other words, by having a radius indicated at 110 which, for example, is between 40-150% of the blade at a region indicated at 112 can be utilized. In this form, by having a greater radius 110, a greater amount of torque can be applied to the actuating system 25. By having a knife which has a certain amount of initial resistance before the spring opening mechanism is utilized, the knife is likely to remain in a retained orientation such that shown FIG. 11. However, when attempting to open it, applying the rotational forces indicated by the arrow 100 will spring the blade to an open orientation with an initial partial movement of the blade 22B with respect to the handle member 24B. As shown in FIG. 11, the handle 24B has a forward perimeter surface 120 where the surface 122 of the interface portion 70B extends therebeyond.

Figure 12:
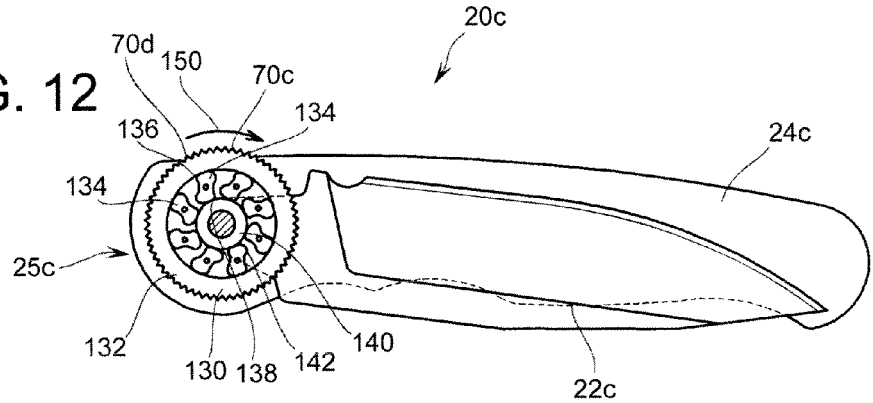
FIG. 12 shows another type of actuating system which in one form provides a sprag-type arrangement to open the blade with respect to the handle.

Now referring to FIG. 12, there is shown yet another embodiment where a sprag-type system is employed. As shown in this embodiment, the folding knife 20*c* has a blade 22*c* and a handle region 24*c*. In this form, the blade actuating mechanism 25*c* is shown, which will now be described in detail.

Figure 13:
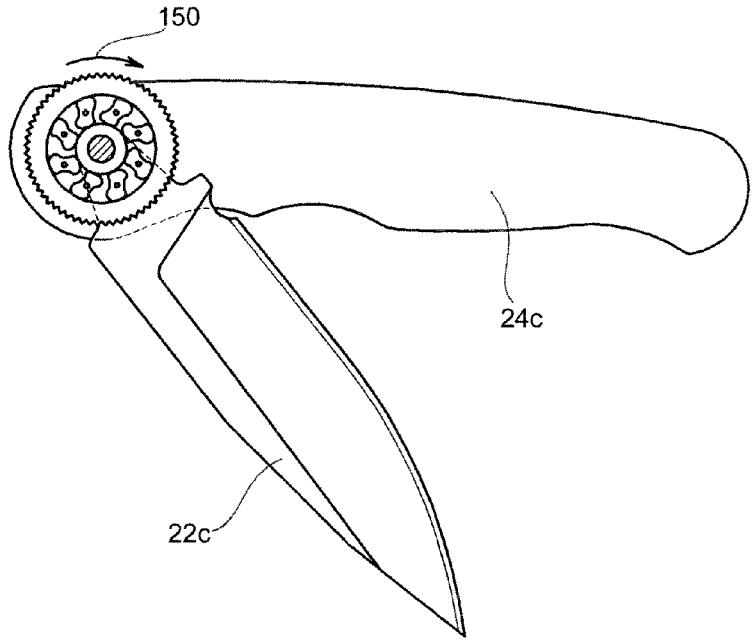
FIG. 13 shows the blade in a partially open orientation.
Figure 14:
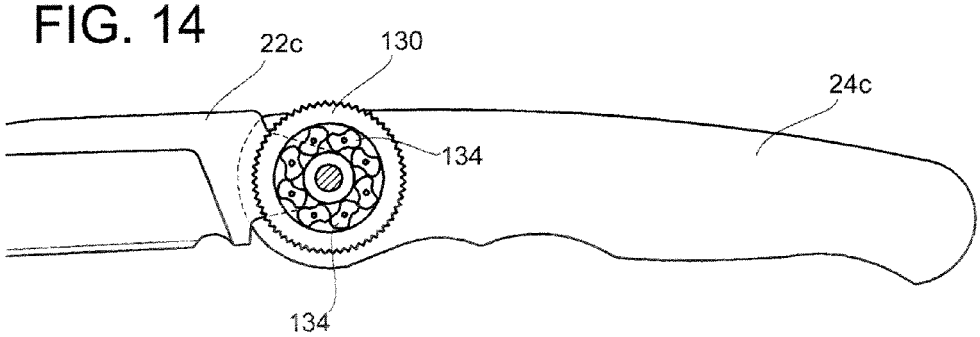
FIG. 14 shows the blade in a fully open orientation where it should be noted that the blade can rotate to the open orientation when the rotating member is stationary with respect to the handle or even rotating in an opposite direction with respect to the rotation of the blade.

In general, the blade actuating mechanism 25*c* comprises a rotating member 130 which in one form is cylindrical about a lateral axis and the member 130 has an outer ring portion 132. The plurality of sprag members 134 are in one form pivotally attached to the cylindrical member 130. Each one of the members 134 comprise an outer engagement surface 136 and an inner engagement surface 138. The contour of the surfaces are such that the actuating mechanism 25*c* will work in a manner where the engagement portion 70*c* will only bias the blade 22*c* in the positive opening direction. To describe the mechanism further, the blade 22*c* is comprised of a pivot mount 140 having an outer surface 142 which is operatively configured to engage the inner engagement surface 138 of the plurality of sprag members 134. Therefore, when an opening force is applied, such as that indicated by the vector 150 as shown in FIGS. 12 and 13, the sprag-like action places a biasing force upon the blade 22*c*. Or, when the blade opens in a fashion as shown in FIG. 14, the cylindrical member 130 does not necessarily rotate with the blade 22*c*. In other words, the plurality of sprag members 134 disengage from the outer surface 142. Of course other types of devices can be utilized to provide a ratcheting, one way like motion which are hereby defined as sprag members and a sprag system.

Figure 15:
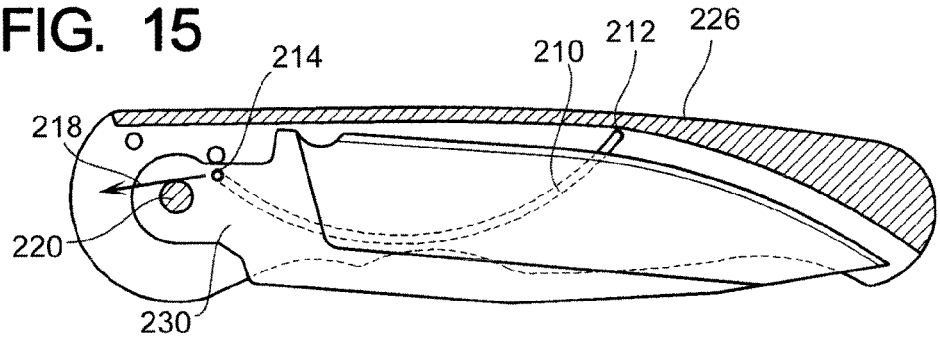
FIG. 15 shows another type of assisted opening technology where a spring member has energy stored therein, as well as the blade in a store energy state.
Figure 16:
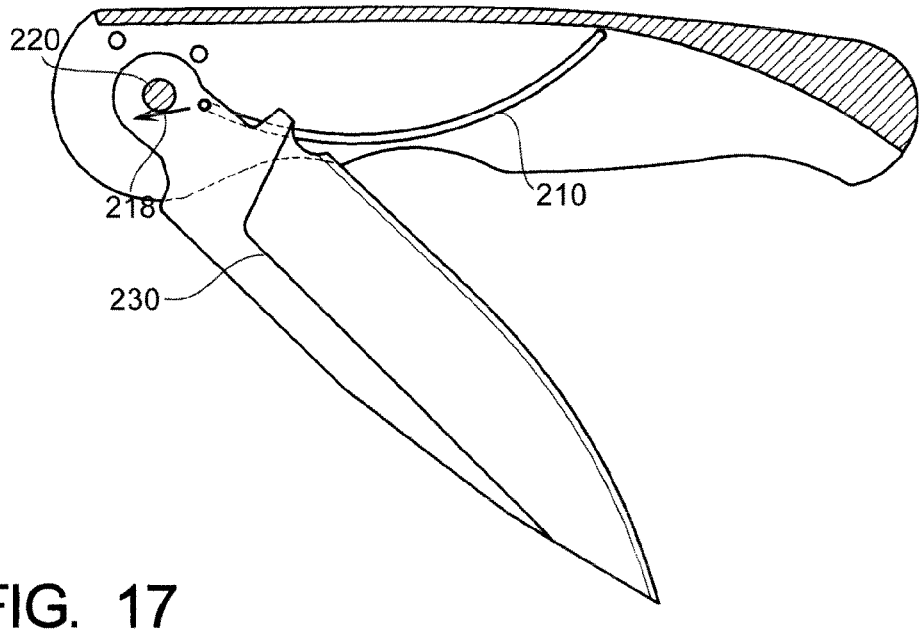
FIG. 16 shows the blade where the force acting upon the blade by the spring member is beyond an equilibrium point thereby biasing in the blade open.
Figure 17:
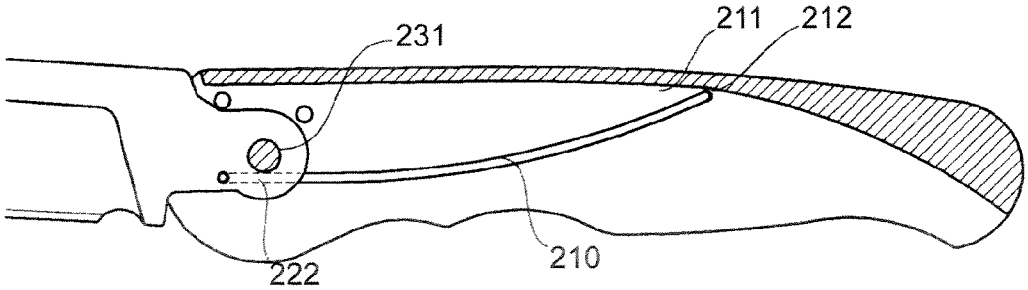
FIG. 17 shows the blade in an extended orientation.

FIGS. 15-17 illustrate other possible assisted opening systems. FIG. 15 shows another embodiment where a spring assisted member 210 is provided and is connected to the handle 226 at the location indicated at 212. The spring member in one form is a compressive buckling-type spring which is further connected at the location 214 upon the blade 230. It can be appreciated that the expansive force of the spring 210 is such that between the connection points 212 and 214, the force substantially extends between these contact points. Therefore, a resultant vector 218 is provided, which is a counter torque with respect to the center of rotation 220 of the blade 230. The interface portion 70*d* can be directly attached to the rotating member 130 or can be intermittently attached for example by a longitudinally extending member configured to reposition the rotating member 130.

There will now be a discussion of various assisted opening technologies that can be incorporated with the designs noted above and of course embodiments broadly covered in the claims.

Figure 19:
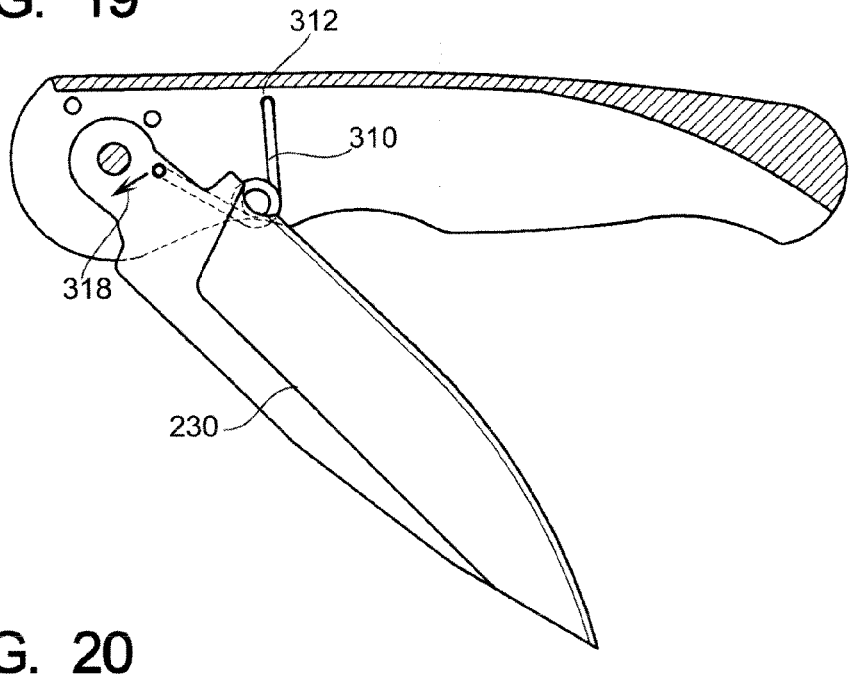
FIG. 19 shows the torsional-type spring positioned beyond an equilibrium point thereby biasing the blade open.

Now referring to FIG. 16, it can be appreciated that the spring 210 is past the center of rotation/rotational point 220 of the blade 230, whereby the resultant vector 218 in FIG. 19 is a positive opening torque upon the blade 230. Now referring to FIG. 17, it can further be appreciated that the spring member 210 is fully extended. In one form, the forward region 222 is positioned adjacent to the center pin member 231. In other forms, a slot can be positioned at the region indicated a 211 so the attachment point 212 will slide therealong to allow the spring member 210 to move longitudinally forward.

Figure 18:
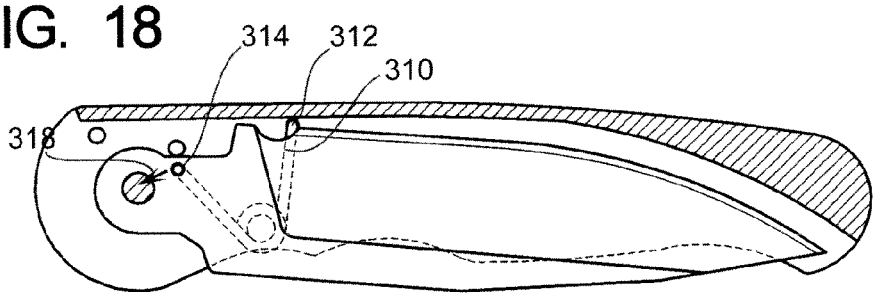
FIG. 18 shows another type of assisted open technology where a torsional type spring in a closed orientation is schematically shown.

Now referring to FIG. 18, there is shown another embodiment where a spring member 310 is provided. In this form, the spring member has an attachment point 312 and a second attachment point 314. This coil-type spring 310 has an expanding coiled energy force between the attachment points 312 and 314 and is in a high-energy state as shown in FIG. 18. In the same manner as above, the resultant vector 318 is forcing the blade into a closed orientation.

Figure 20:
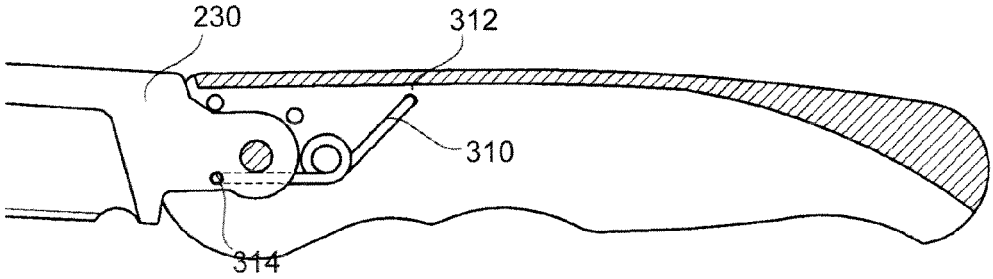
FIG. 20 shows the blade in an open orientation.

Now referring to FIG. 19, it can be appreciated that the resultant vector 318 biases the blade 232 in an open orientation. FIG. 20 shows the spring member 312 in a fully extended orientation with the blade 230 fully extended.

Figure 21:
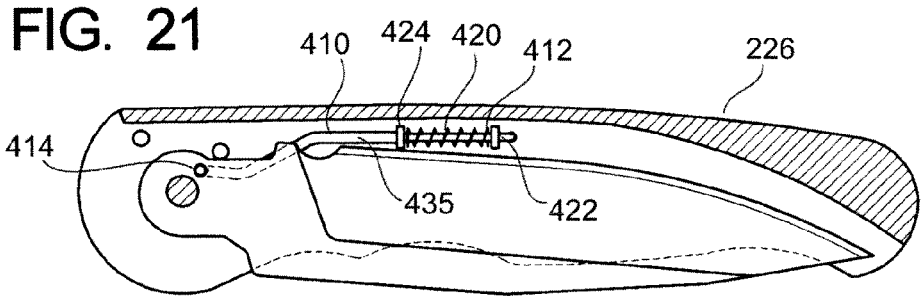
FIG. 21 shows another assisted opening technology utilizing an extending mechanism such as a plunger extending device.
Figure 22:
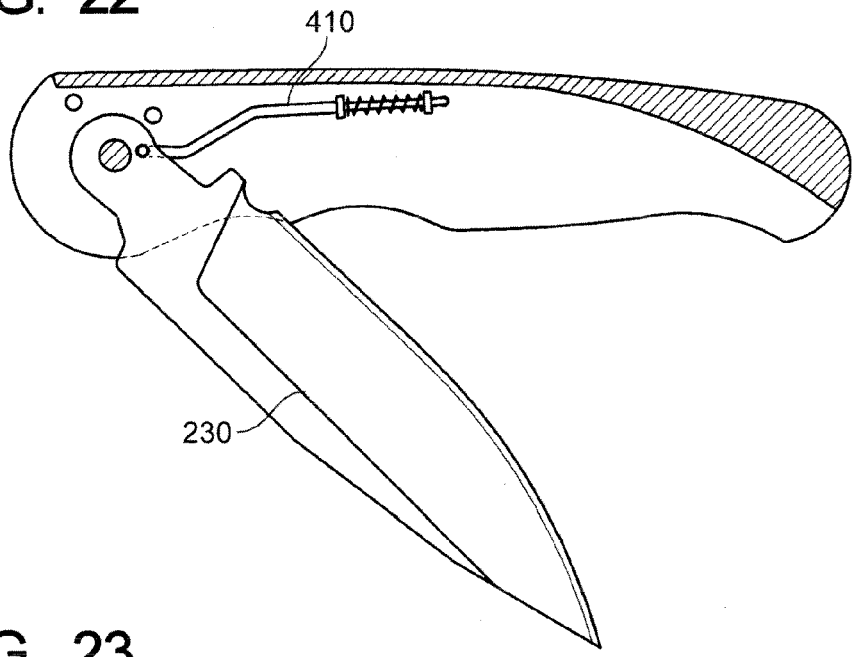
FIG. 22 shows the extending mechanism past the equilibrium point.
Figure 23:
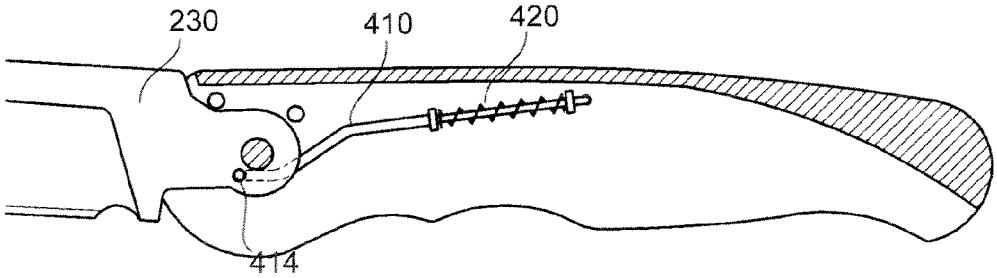
FIG. 23 shows the extending mechanism assisted opening device in the blade open orientation.

Now referring to FIG. 21, there is shown another embodiment where attached to the handle region 226 where the spring member 410 is a plunger-like spring where an actual spring element 420 is provided. In this form, the attachment point is located at 412, and a plunger-like extension member 422 can in one form extend within the hollow region within the tube portion 435. Of course, in other forms, this extension can extend through a washer-like attachment member 412. The spring abuts against the stop 424. The second attachment point 414 is on the blade and the resultant vector is present similar to the matter as described above. In this form, when the blade 230 opens beyond a prescribed level, the blade repositions to a fully opened orientation as shown in FIG. 23 where the actual spring element 420 is fully extended.

Figure 24:
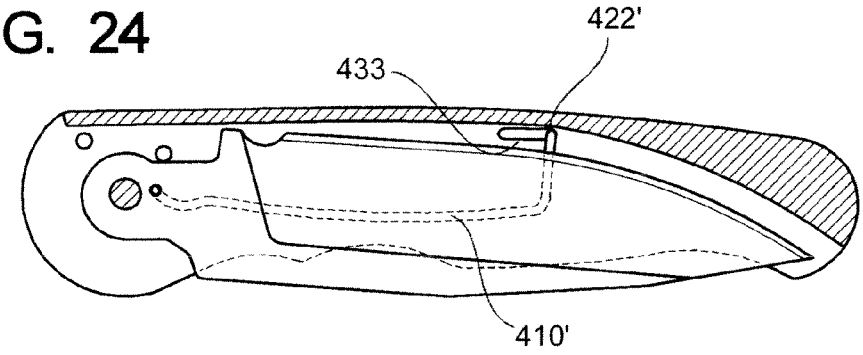
FIG. 24 shows another assisted opening technology utilizing a buckled spring mechanism.
Figure 25:
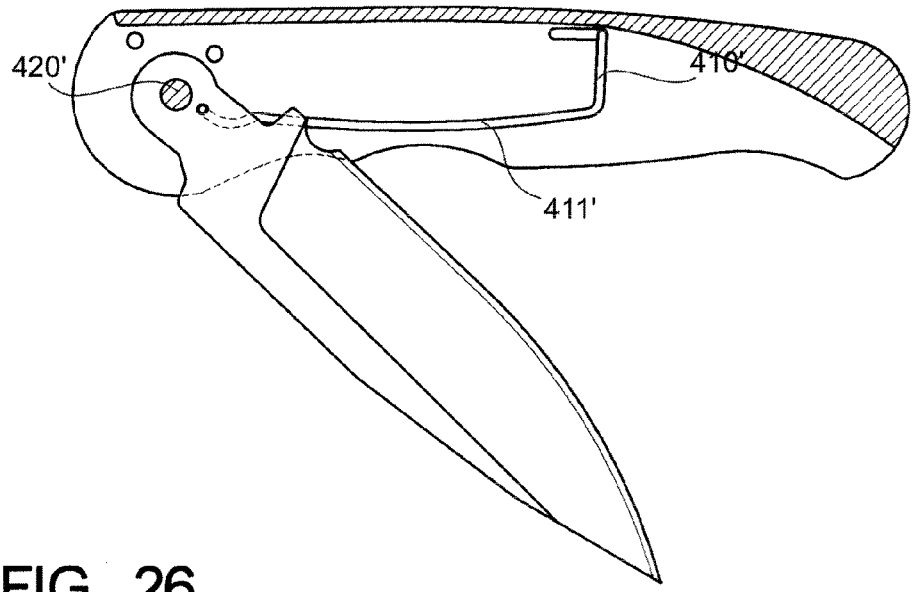
FIG. 25 shows the buckled spring mechanism past the equilibrium point.
Figure 26:
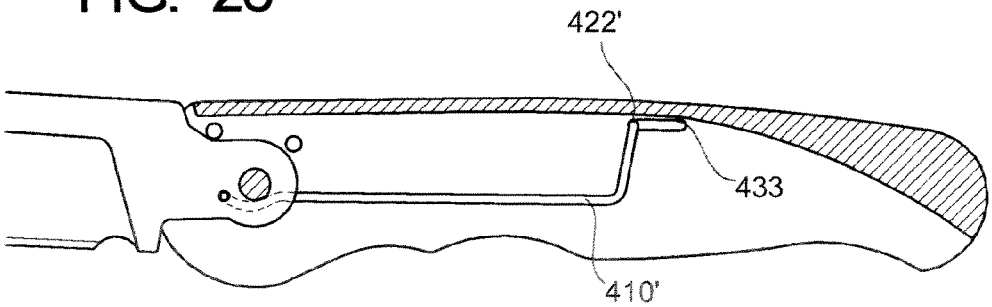
FIG. 26 shows the buckled spring mechanism assisted opening device in the blade open orientation.

Now referring to FIGS. 24-26, there is shown a similar type of embodiment where the spring member 410' is in a slight compressive force as shown in FIG. 24*a*. The connection point 422' is fitted within the slot member 433 as shown in FIG. 25, it can be appreciated that the stored energy within the elongated region 411' of the spring member 410' is such that a resultant force is past the center of rotation indicated at 420'. FIG. 26 shows the spring member 410' in an extended orientation where the attachment portion 422' is in the longitudinal front portion of the surface defining the slot 433.

Figure 27:
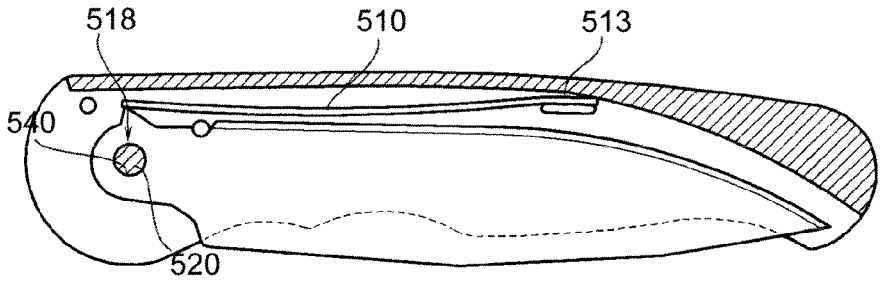
FIG. 27 shows a dog down leaf springlike embodiment where the blade is in the stored orientation.

FIG. 27 shows another embodiment of an assisted opening technology where the spring member is a dog down-like leaf spring element 510.

Figure 28:
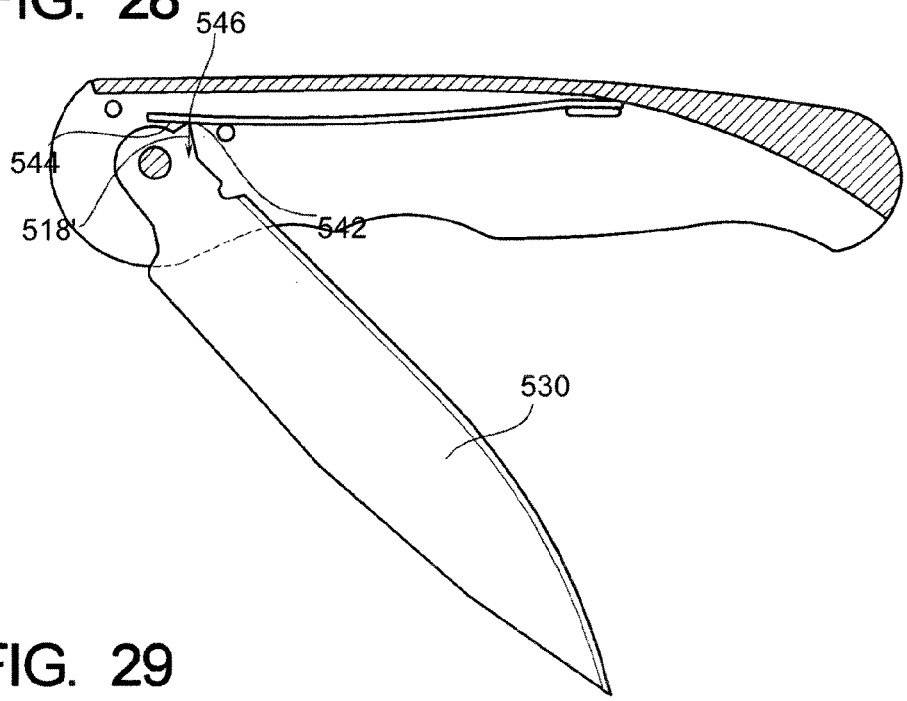
FIG. 28 shows an extension of the blade beyond the equilibrium point whereby the spring which in one form is a leaf spring is exerting a force thereupon to open the blade.
Figure 29:
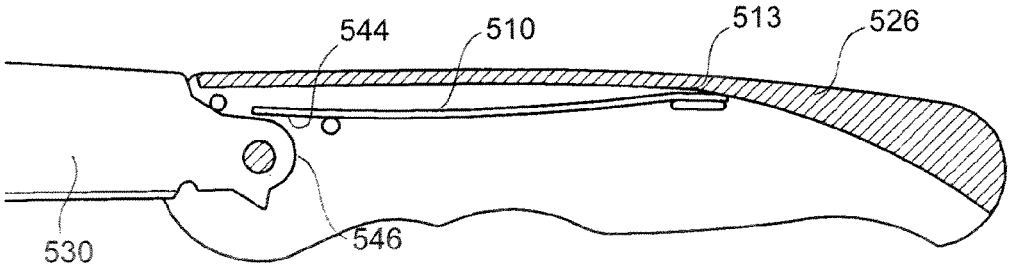
FIG. 29 shows the blade in an open orientation.

The dog down leaf spring 510 acts as a dynamic spring to provide an assisted opening initially. In this form, the center of rotation of the knife indicated at 520 is such that the force exerted by the leaf spring at the engagement point 540 is such that the resultant vector 518 produces a negative torque upon the knife, biasing it to a closed orientation. When the knife is rotated in an opening direction by an external force upon the blade, the resultant vector 518 moves to the right of the center point 520 (in the orientation is shown in FIG. 27). Thereafter, the dog down leaf spring extension 542 slides along the engagement surface 544. The engagement point 546 as show in FIG. 28 illustrates that a normal force indicated at 518' continues to bias the blade member 532 in an open orientation. In this form, the inertia of the blade 530 continues to open the blade with respect to the housing 526. The tang portion 546 is configured to slide along the region 544 of the spring member 510. The spring member can be mounted in a cantilevered spring at a location 513. It should be noted that in this form, the spring member 510 can be in line with the blade in the transverse planes. Alternatively, the spring member 510 can extend inwardly into the channel of the handle member 526.

Figure 30:
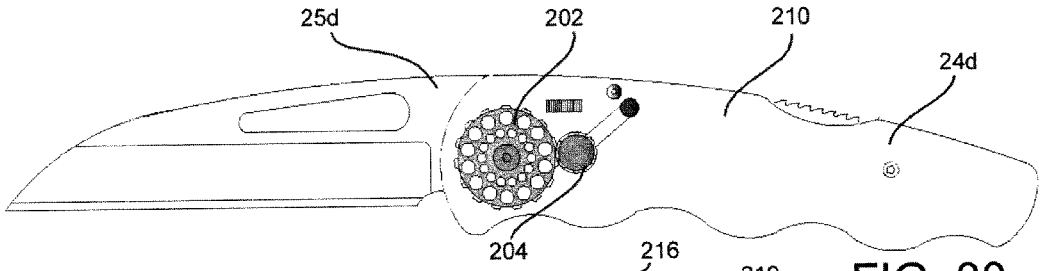
FIG. 30 shows another embodiment of another actuating system with the blade open.
Figure 31:
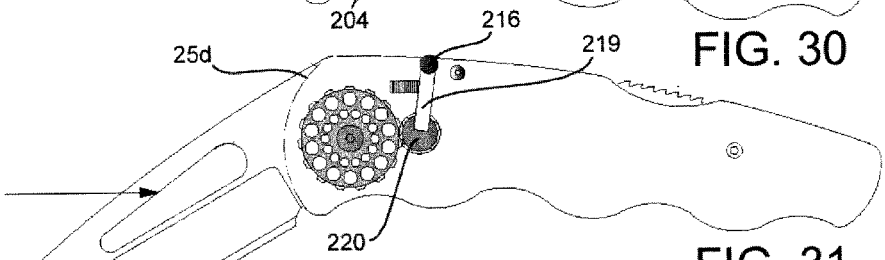
FIG. 31 shows another embodiment where the actuating system has a gear member having an offset axis of rotation that the center of rotation of the blade.

Now referring to FIG. 30, there is yet another embodiment where the actuating system 25*d* is shown where the knife gear 202 is gearingly engaged or otherwise attached to the actuating gear, otherwise referred to as a first gear member 204. In one form, the gear 202 can be exposed outside of the lateral surface region 210 of the handle 24*d* or can extend within the handle region and not be exposed. As shown in (for example) FIG. 31, the engagement surface 216 can be attached to a lever member 219, extending the applied torque away from the pivot point/center of rotation 220. Therefore, the actuating system 25*d* functions by reeling in the blade.

Figure 32:
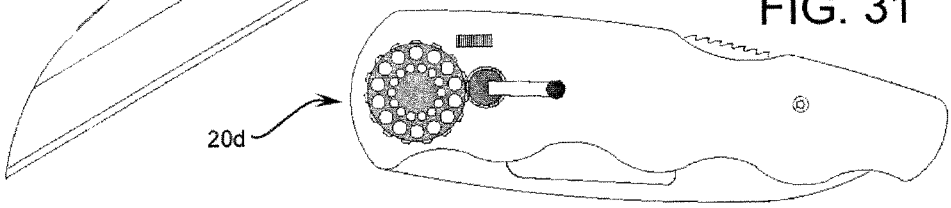
FIG. 32 shows the knife in a closed orientation.
Figure 33:
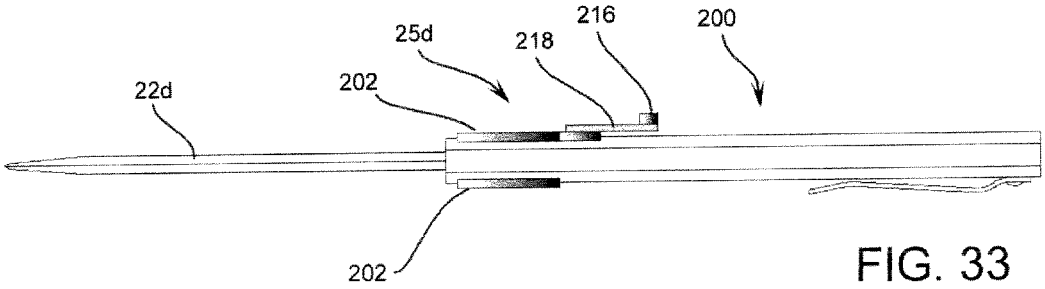
FIG. 33 shows the knife along the transverse axis.

FIG. 32 shows the additional embodiment 20*d* where the blade is in a closed orientation. Now referring to FIG. 33, there is shown a top view taken along the transverse axis, and it can be seen how the folding knife member 20*d* can have the lever member 219 and the engagement surface 216 extending laterally outward from the blade. FIG. 33 further illustrates how the actuating interface portion of the actuating system 25*d* can be placed on either side of the blade and in one form be re-positionable where, for example, there are first and second knife gear members 202 positioned on either side of the blade which are both coupled to rotate with the blade 22*d*.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. A folding knife comprising:

a) a handle region having a forward portion, a rearward portion, and an upper transverse surface, b) a blade having an end region and a base region, the blade being pivotally attached to the handle at the forward region, the blade further having a fixedly attached knife gear configured to rotate around a pivot attachment location of the blade, c) an actuating system comprising an interface portion coupled with the blade using a torque transferring mechanism including a first gear member coupled with the knife gear and wherein the interface portion has an engagement surface extending beyond the upper transverse surface of the handle region, where repositioning the interface portion actuates the blade from a retracted orientation to an extended orientation where the blade is withdrawn from the handle to the extended orientation where the blade can rotate an angular quantity greater than the angular quantity of rotation of the interface portion of the actuating system.

2. The folding knife as recited in claim 1 where the interface portion is pivotally attached to the forward region of the handle and the interfacing portion is gearingly attached to the blade.

3. The folding knife as recited in claim 2 where a gear is fixedly attached to the blade where the gear ratio between the gear attached to the blade and a gear system attached to the engagement region is less than a 2:3 ratio.

4. The folding knife as recited in claim 1 where the interface portion is positioned on a first transverse region of the handle.

5. The folding knife as recited in claim 1 where the interface portion is positioned on a forward lateral location of the folding knife.

6. The knife as recited in claim 4 where the actuating system comprises an engagement surface extending beyond the forward perimeter region of the handle.

7. A folding knife to be opened by a finger of a knife operator, the folding knife comprising:

a) a handle having a rearward portion, a forward portion, and an upper transverse surface, b) a blade having an end region and a base region, the base region pivotally attached to the forward region of the handle, the blade being operatively configured to be arranged in a closed orientation and in an open orientation, the blade further having a fixedly attached knife gear configured to rotate around a pivot attachment location of the blade, c) an actuating system comprising an interface portion coupled with the blade using a torque transferring mechanism including a first gear member coupled with the knife gear and wherein the interface portion has an engagement surface extending beyond the upper transverse surface of the handle region, the interface portion positioned in the forward region of the handle to be engaged by the finger of the knife operator, the actuating system operatively configured where repositioning the interface portion with respect to the handle repositions the blade from a closed orientation to an open orientation with the rotation of the interface portion being a different amount of rotation than the degree of rotation of the blade.

8. The folding knife as recited in claim 7 where the handle further comprises a first transverse region and a second transverse region where the interface portion is positioned in the first transverse region of the handle.

9. The folding knife as recited in claim 7 where the first gear member has an axis of rotation that is not concentric with the knife gear.

10. The folding knife as recited in claim 7 where the gear ratio between the first gear and the knife gear is other than 1:1.

11. A folding knife comprising:

a) a handle region having a forward portion, a rearward portion, and an upper transverse surface, b) a blade having an end region and a base region, the blade being pivotally attached to the handle at the forward region, the blade further having a fixedly attached knife gear configured to rotate around a pivot attachment location of the blade, c) an actuating system comprising an interface portion coupled with the blade using a torque transferring mechanism including a first gear member coupled with the knife gear and wherein the interface portion has an engagement surface extending beyond the upper transverse surface of the handle region, where repositioning the interface portion actuates the blade from a retracted orientation to an extended orientation where the blade is withdrawn from the handle to the extended orientation and the blade rotates an angular quantity less than the angular amount of rotation of the interface portion of the actuating system.

12. The folding knife as recited in claim 11 where the interface portion is pivotally attached to the forward region of the handle and the interfacing portion is gearingly attached to the blade.

13. The folding knife as recited in claim 11 where the interface portion is a wheel member positioned on a first transverse region of the handle.

14. The folding knife as recited in claim 11 where the interface portion is positioned on a forward lateral location of the folding knife.

* * * * *